US006668384B1

(12) United States Patent
Chang

(10) Patent No.: US 6,668,384 B1
(45) Date of Patent: Dec. 30, 2003

(54) SEAMLESS FRONT FLAP ASSEMBLY

(75) Inventor: Yung Sheng Chang, Taipei (TW)

(73) Assignee: J. Adams & Associates Limited, Taipei (TW)

( * ) Notice: Subject to any disclaimer, the term of this patent is extended or adjusted under 35 U.S.C. 154(b) by 0 days.

(21) Appl. No.: 10/414,900

(22) Filed: Apr. 16, 2003

(51) Int. Cl.[7] ..... A41D 1/00
(52) U.S. Cl. ..... 2/96; 24/389
(58) Field of Search ..... 2/69, 77, 79, 80, 2/85, 87, 93, 96, 102, 106, 108, 115, 121, 122, 275, 266, 243.1, DIG. 5; 24/389, 384, 432, 397, 398, 394; 42/418, 475.16, 441, 475.09, 406; 156/93

(56) References Cited

U.S. PATENT DOCUMENTS 2,148,269 A * 2/1939 Koch ..... 2/96
2,371,776 A * 3/1945 Van Orman ..... 2/96
3,449,764 A * 6/1969 De Fazio et al. ..... 2/96
3,962,729 A * 6/1976 Cook ..... 2/234
4,628,545 A * 12/1986 Metzler ..... 24/432 X
5,159,719 A * 11/1992 Aumann ..... 2/87
5,386,616 A * 2/1995 Norvell ..... 24/389
5,444,898 A * 8/1995 Norvell ..... 24/389
5,529,823 A * 6/1996 Aumann ..... 428/53
6,223,349 B1 * 5/2001 Roiser ..... 2/82
6,571,432 B1 * 6/2003 Rindle ..... 24/432

* cited by examiner

*Primary Examiner*—Gloria M. Hale
(74) *Attorney, Agent, or Firm*—Ladas & Parry

(57) ABSTRACT

A seamless front flap assembly for a garment having a first front panel and a second front panel in a side-by-side configuration, the assembly comprising: a top storm flap including: an upper fabric; a lower fabric stitched to the upper fabric of the top storm flap; and a thermally meltable compound; a bottom storm flap including: an upper fabric; a lower fabric stitched to the upper fabric of the bottom storm flap; and a thermally meltable compound; a first zipper anchoring flap including: an upper fabric stitched to the lower fabric of the top storm flap; and a lower fabric stitched to the upper fabric of the first zipper anchoring flap; a second zipper anchoring flap including: an upper fabric stitched to the lower fabric of the bottom storm flap; and a lower fabric stitched to the upper fabric of the second zipper anchoring flap; and a zipper.

20 Claims, 5 Drawing Sheets

SEAMLESS FRONT FLAP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

DESCRIPTION

1. Field of the Invention

The present invention relates to a seamless front flap assembly. Specifically, the present invention relates to a seamless front flap assembly for a front shell of a waterproof garment.

2. Description of the Related Art

FIGS. 1–3 show a conventional waterproof jacket. The jacket is made by stitching a plurality of the impregnated man-made shell fabrics together and has two opposite front panels. The front flap assembly for the jacket is constructed by first stitching an outer flap and an inner flap respectively with each of the front panels. A zipper tape is further located below the outer flap and stitched therein, while the other zipper tape is located above the inner flap and stitched therein. Based on the above structure, when the two zipper tapes are engaged to form a zipper, the outer flap and the inner flap enclose the zipper tapes such that water cannot pass through the zipper tapes rendering the waterproof effect. However, as shown by the broken lines in FIG. 2, water can still penetrate into the front panels through the needle holes of the stitching and eventually the jacket cannot be 100% waterproof.

To eliminate the above problem, for the shell fabrics, thermal tapes are provided under the stitching to ensure the waterproof effect. Since the thermal tape cannot be positioned on the front flap portion of the jacket for appearance reasons, instead of the stitching, glue has been used to join the outer and inner flaps to the zipper tapes. However, the glued front flap portion usually has a strong smell and the quality thereof is not stable. Further, the production output is low and the cost incurred is high. The above factors make the glued waterproof jacket less competetive in the market.

FIGS. 4–6 show another conventional seamless front flap assembly is widely used in the current outdoor waterproof jacket. In this instance, an outer flap is respectively stitched on each of the opposite front panels, with the upper one used to block the water and the lower one served as a gutter. A zipper tape is positioned below the respective outer flap and further stitched to the front panel. To prevent the water from penetrating into the needle holes of the stitching between the outer flap and the front panel, a thermal tape is positioned under the stitching.

However, with two flaps positioned on the top of the zipper tapes by stitching, the jacket not only consumes more fabrics, the front of the jacket is also stressed by the flaps and makes the wearer feel uncomfortable. Even though this type of jacket is waterproof, the front of the jacket is never clean and neat.

FIGS. 7–9 show a seamless front flap assembly disclosed in the pending U.S. Ser. No. 10/213,199, where improvements have been made to prevent water from penetrating into the front panels through the needle holes of the stitching.

This invention is related to an improved version of the pending U.S. Ser. No. 10/213,199 featuring an extra piece of fabric to provide additional anchoring for the zipper tapes.

BRIEF SUMMARY OF THE INVENTION

An objective of the present invention is to provide a seamless front flap assembly for a garment, which is waterproof.

Another objective of the present invention is to provide a seamless front flap assembly for a garment, which makes the front of the garment look neat and elegant.

The other objective of the present invention is to provide a seamless front flap assembly for a garment, which features extra pieces of fabric to provide additional anchoring for the zipper tapes.

A further objective of the present invention is to provide a seamless front flap assembly for a garment, which features a lower outer flap to serve as a gutter to enhance the water blocking effect.

To achieve these objectives, the seamless front flap assembly in accordance with the present invention for a garment having a first front panel and a second front panel in a side-by-side configuration, the assembly comprises: a top storm flap including: an upper fabric; a lower fabric stitched to the upper fabric of the top storm flap; and a thermally meltable compound for adhering the upper fabric to the lower fabric of the top storm flap; a bottom storm flap including: an upper fabric; a lower fabric stitched to the upper fabric of the bottom storm flap; and a thermally meltable compound for adhering the upper fabric to the lower fabric of the bottom storm flap; a first zipper anchoring flap including: an upper fabric stitched to the lower fabric of the top storm flap; and a lower fabric stitched to the upper fabric of the first zipper anchoring flap; a second zipper anchoring flap including: an upper fabric stitched to the lower fabric of the bottom storm flap; and a lower fabric stitched to the upper fabric of the second zipper anchoring flap; a zipper including: a first zipper tape and a second zipper tape, each zipper tape being stitched to the first zipper anchoring flap and the second zipper anchoring flap, respectively.

The structure and objectives of the present invention can be more readily understood by persons skilled in the art from the following description of the preferred embodiments taken in conjunction with the accompanying drawings.

DETAILED DESCRIPTION OF THE INVENTION

Figure 1:
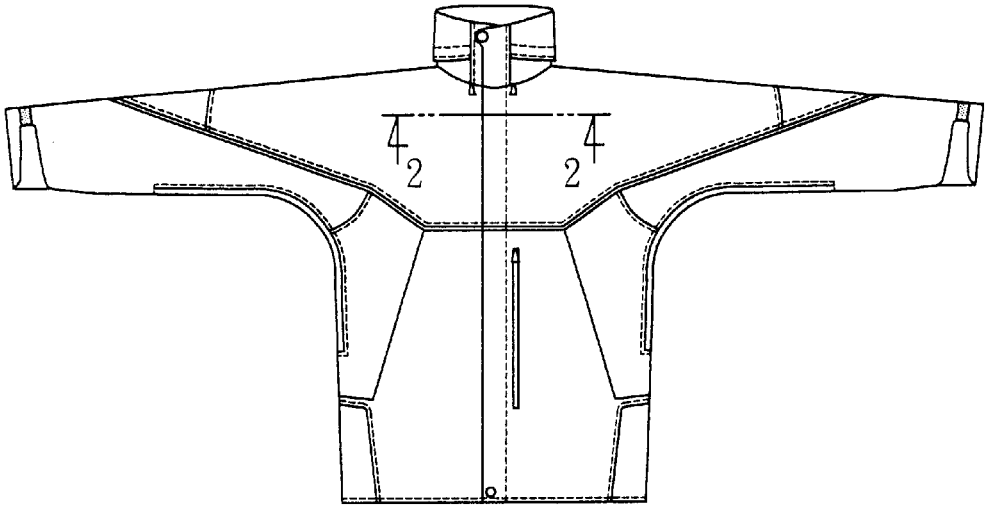
FIG. 1 (PRIOR ART)
FIG. 1 is a front elevation view of a conventional jacket.
Figure 2:
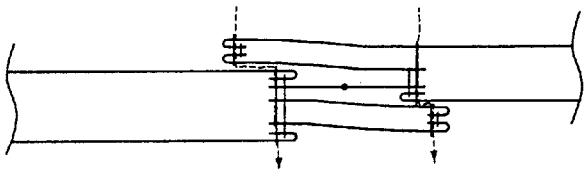
FIG. 2 (PRIOR ART)
FIG. 2 is a cross-sectional view taken along Lines 2—2 in FIG. 1.
Figure 3:
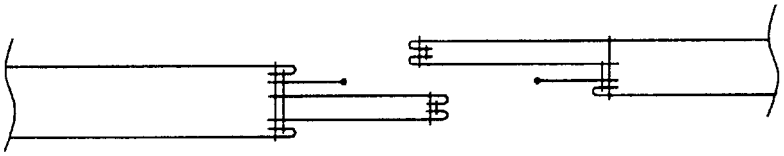
FIG. 3 (PRIOR ART)
FIG. 3 is a cross-sectional view of FIG. 2, wherein the jacket is in an open state.
Figure 4:
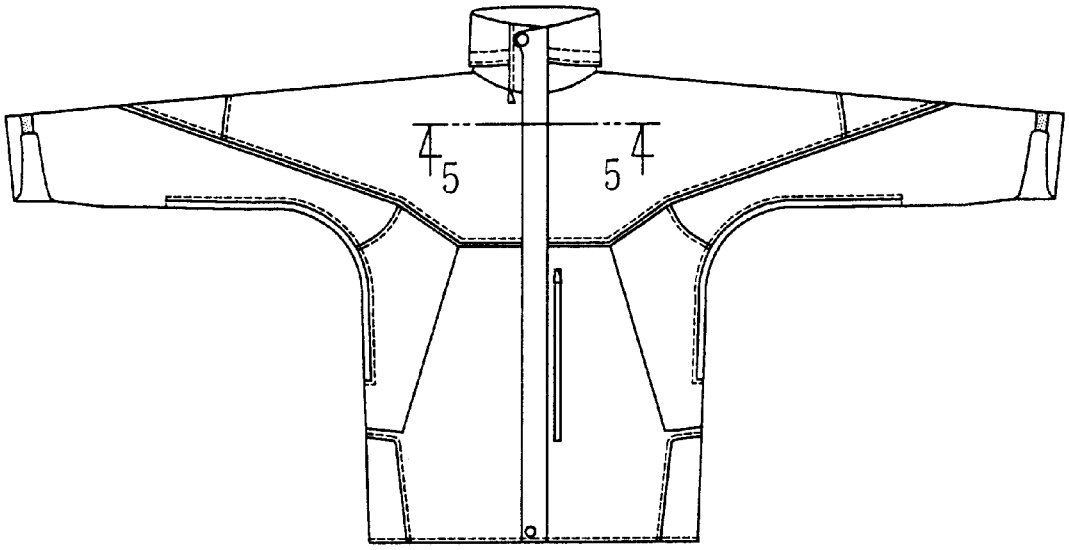
FIG. 4 (PRIOR ART)
FIG. 4 is a front elevation view of the other conventional jacket.
Figure 5:
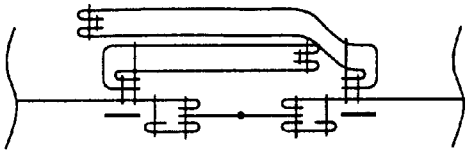
FIG. 5 (PRIOR ART)
FIG. 5 is a cross-section view taken along Lines 5—5 in FIG. 4.
Figure 6:
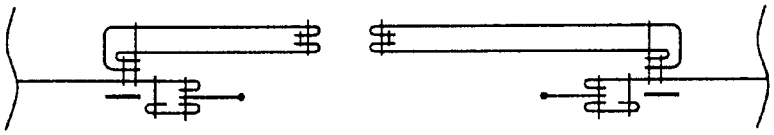
FIG. 6 (PRIOR ART)
FIG. 6 is a cross-sectional view of FIG. 5, wherein the jacket is in an open state.
Figure 7:
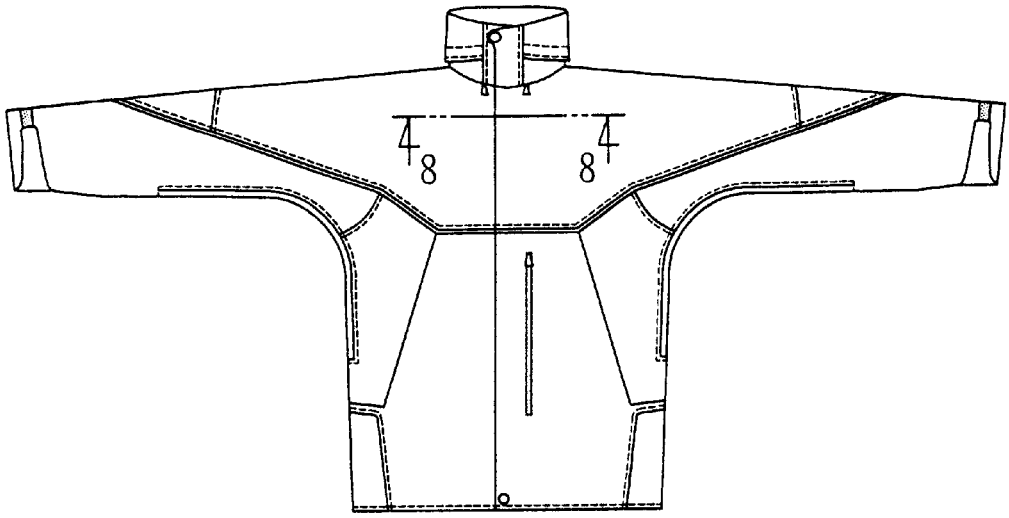
FIG. 7 (PRIOR ART)
FIG. 7 is a front elevation view of jacket including a prior seamless front flap assembly.
Figure 8:
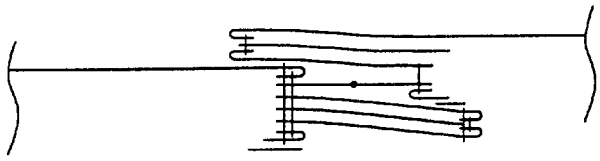
FIG. 8 (PRIOR ART)
FIG. 8 is a cross-sectional view taken along Lines 8—8 in FIG. 7.
Figure 9:
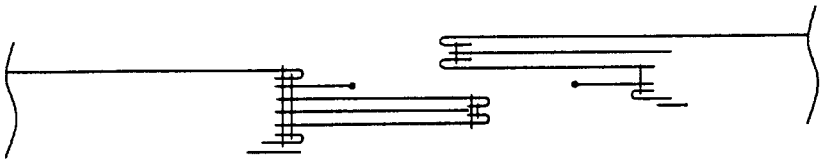
FIG. 9 (PRIOR ART)
FIG. 9 is a cross-sectional view of FIG. 7, wherein the jacket is in an open state.
Figure 10:
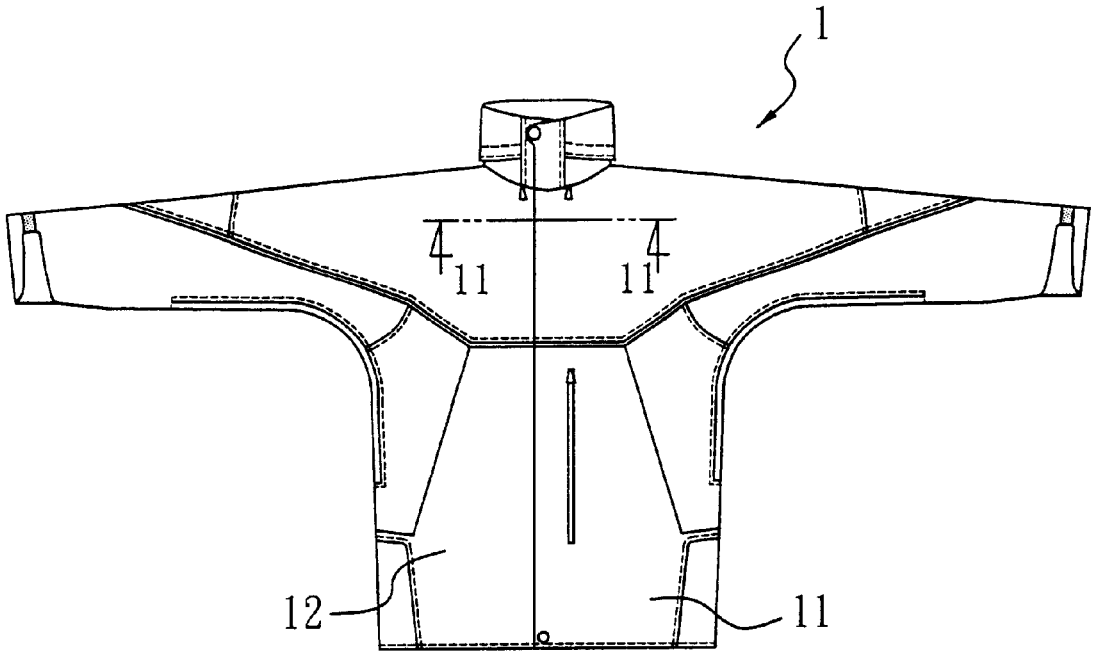
FIG. 10 is a front elevation view of a jacket in accordance with the present invention.
Figure 11:
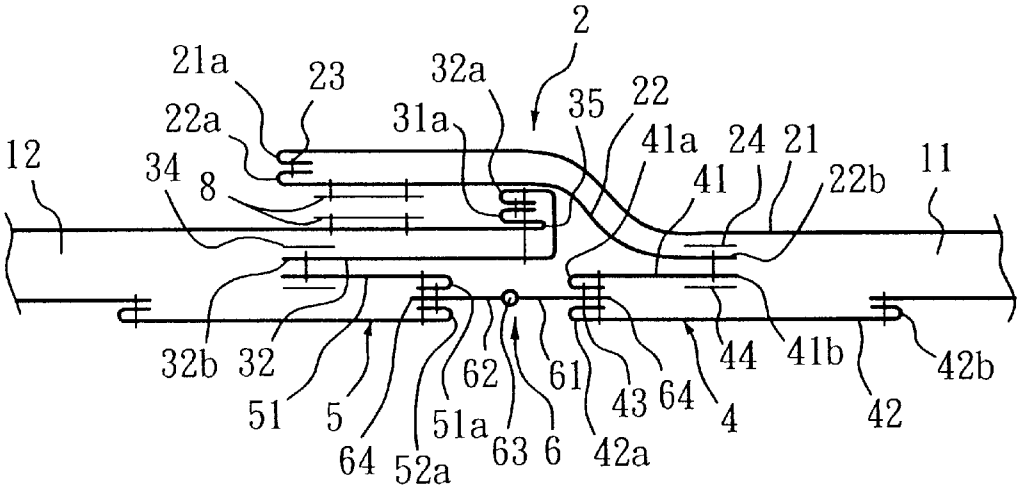
FIG. 11 is a cross-sectional view taken along Lines 11—11 in FIG. 10.
Figure 12:
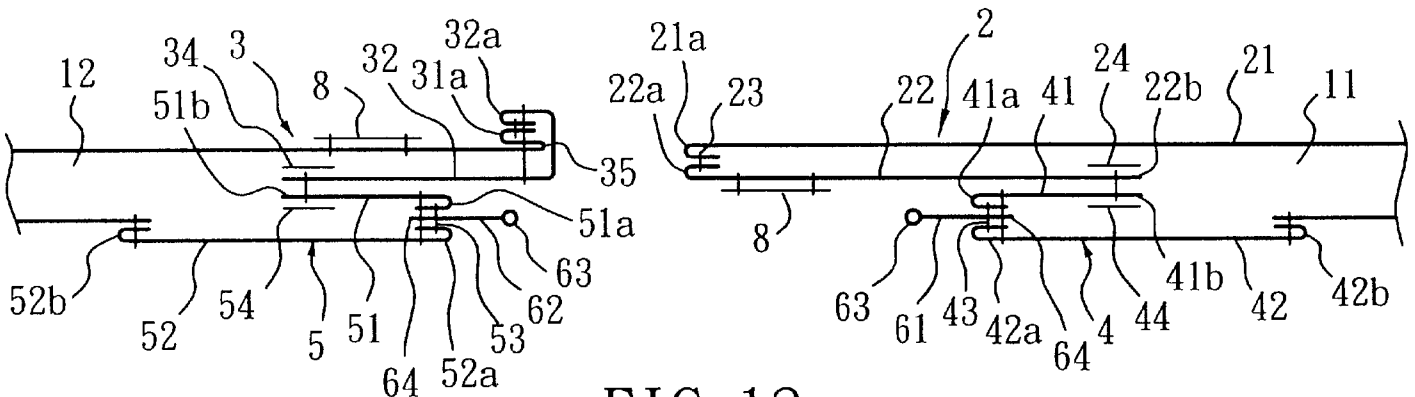
FIG. 12 is a cross-sectional view of FIG. 10, wherein the jacket is in an open state.

FIGS. 10–12 show the jacket with a seamless front flap assembly in accordance with a preferred embodiment of the present invention. As shown, the jacket 1 comprises a first front panel 11 and a second front panel 12 in a side-by-side configuration.

As best seen in FIG. 11, the seamless front flap assembly in accordance with the preferred embodiment of the present invention comprises a top storm flap 2, a bottom storm flap 3, a first zipper anchoring flap 4, a second zipper anchoring flap 5, and a zipper 6.

The top storm flap 2 includes an upper fabric 21 having a free end 21*a* extending from the first front panel 11, a lower fabric 22 having a free end 22*a* stitched to the free end 21*a* of the upper fabric 21 by concealed stitching 23 and a fixing end 22*b*, and a thermally meltable compound 24 (such as a thermal meltable polyurethane resin in the form of a glue film), provided at the fixing end 22*b* of the lower fabric 22 for adhering the upper fabric 21 to the lower fabric 22.

The bottom storm flap 3 includes an upper fabric 31 having a free end 31*a* extending from the second front panel 12, a lower fabric 32 having a free end 32*a* stitched to the free end 31*a* of the upper fabric 31 by concealed stitching 33 and a fixing end 32*b*, and a thermal meltable compound 34 (such as a thermally meltable polyurethane resin in the form of a glue film) provided at the fixing end 32*b* of the lower fabric 32 for adhering the upper fabric 31 to the lower fabric 32. If desired, the free ends 31*a*, 32*a* of the upper fabric 31 and lower fabric 32 may be folded over towards the upper fabric 31 and stitched to the upper fabric 31 at opposing ends to form a gutter 35 to provide additional water blocking effect.

The first zipper anchoring flap 4 includes an upper fabric 41 having a free end 41*a* and a fixing end 41*b* stitched to the fixing end 22*b* of the lower fabric 22 of the top storm flap 2, a lower fabric 42 having a free end 42*a* stitched to the free end 41*a* of the upper fabric 41 by concealed stitching 43. Preferably, a thermal tape 44 is positioned to the fixing end 41*b* of the upper fabric 41 where the fixing end 41*b* is stitched to the fixing end 22*b* of the lower fabric 22 of the top storm flap 2 to enhance the waterproof effect.

The second zipper anchoring flap 5 includes an upper fabric 51 having a free end 51*a* and a fixing end 51*b* stitched to the fixing end 32*b* of the lower fabric 32 of the bottom storm flap 3, and a lower fabric 52 having a free end 52*a* stitched to the free end 51*a* of the upper fabric 51 by concealed stitching 53. Preferably, a thermal tape 54 is positioned to the fixing end 51*b* of the upper fabric 41 where the fixing end 51*b* is stitched to the fixing end 32*b* of the lower fabric 32 of the bottom storm flap 3 to enhance the waterproof effect.

The zipper 6 includes a first zipper tape 61 and a second zipper tape 62, each having a tooth side 63 and a fixing side 64 stitched to the free ends 41*a*, 42*a* of the first zipper anchoring flap 5 and the free ends 51*a*, 52*a* of the second zipper anchoring flap 6, respectively.

As shown in FIGS. 11 and 12, the lower fabrics 42, 52 of the first and second zipper anchoring flaps 4, 5 may each include a free end 42*b*, 52*b* being stitched to a lining of the jacket 1.

Based on the above structure, and by using a thermal welding machine to heat the thermally meltable compound 24, 34, and the thermal tapes 44, 54, the molten and then cured compound 23, 33 will adhere the upper fabrics 21, 31 to the lower fabrics 22, 32, while the molten and then cured thermal tapes 44, 54 will adhere to the stitching at the fixing ends 41*b*, 51*a* of the upper fabrics 41, 51, respectively. As such, the seamless front panel assembly in accordance with a preferred embodiment of the present invention is constructed.

When the tooth side 63 of the zipper tapes 61, 62 are engaged with each other, the bottom storm flap 3, preferably extending beyond where the tooth sides 63 engage to further enhance the waterproofing effect, and the top storm flap 2 extends above the bottom storm flap 3.

If the free ends 31*a*, 32*a* of the upper fabric 31 and lower fabric 32 are folded over towards and stitched to the upper fabric 31 at opposing ends to form a gutter 35 as shown in FIGS. 11 and 12, the top storm flap 2 extending above the bottom storm flap 3 helps to cover up the needle holes of the stitching.

Preferably, additional matching fasteners 8, such as snap buttons or mechanical loop-hook fasteners, may be provided to the lower fabric 22 of the top storm flap 2 and the top layer fabric 31 of the bottom storm flap 3 such that the top storm flap 2 may be properly attached to the bottom storm flap 3 upon engagement of the zipper tapes 61, 62.

As such, there will be no stitching found on the upper fabric 21 of the top storm flap 2 and the front panels 11, 12, whereby no water can penetrate into the front panels 11, 12.

To further improve the waterproof effect, the first and second front panels 11, 12, the outer and bottom storm flaps 2, 3, the first and second zipper tapes 61, 62 may be made of woven or knit man-made fabric (such as nylon, polyester, TC, CN), or impregnated fabrics (such as PU, PTFE, PVC, or rubber coated/laminated fabrics). However, it should be noted that while applying the present invention to other types of jackets, the shell fabrics for the jacket can also be non-impregnated, especially highly breathable fabrics, which makes the jacket fashionable with a neat seamless outer appearance.

In accordance with the present invention, the seamless front flap assembly for a garment is waterproof and provides additional zipper anchoring flaps to help fix the zipper so as to render a neat and elegant appearance for the front of the garment. The gutter provided by the lower outer flap also helps to enhance the water blocking effect.

The structure of the present invention is not limited to the above embodiments. For example, the zipper can be replaced by snap-on buttons, mechanical loop-hook fasteners, etc. Although the invention has been described with reference to the preferred embodiments, it will be obvious to persons skilled in the art that various changes and modifications may be made without departing from the scope of the invention as recited in the claims.

What is claimed is:

1. A seamless front flap assembly for a garment having a first front panel and a second front panel in a side-by-side configuration, the assembly comprising:

a top storm flap including: an upper fabric having a free end extending from the first front panel; a lower fabric having a free end stitched to the free end of the upper fabric and a fixing end; and a thermally meltable compound provided at the fixing end of the lower fabric for adhering the upper fabric to the lower fabric of the top storm flap;

a bottom storm flap including: an upper fabric having a free end extending from the second front panel; a lower fabric having a free end stitched to the free end of the upper fabric; and a thermally meltable compound provided at the fixing end of the lower fabric for adhering the upper fabric to the lower fabric of the bottom storm flap;

a first zipper anchoring flap including: an upper fabric having a free end and a fixing end stitched to the fixing end of the lower fabric of the top storm flap; and a lower fabric having a free end stitched to the free end of the upper fabric;

a second zipper anchoring flap including: an upper fabric having a free end and a fixing end stitched to the fixing end of the lower fabric of the bottom storm flap; and a lower fabric having a free end stitched to the free end of the upper fabric;

a zipper including: a first zipper tape and a second zipper tape, each zipper tape having a tooth side and a fixing side, wherein the fixing sides are stitched to the free ends of the first zipper anchoring flap and the free ends of the second zipper anchoring flap, respectively.

2. The seamless front panel assembly according to claim 1, wherein the free end of the lower fabric of the top storm flap is stitched to the free end of the upper fabric of the top storm flap by concealed stitching.

3. The seamless front panel assembly according to claim 1, wherein the free end of the lower fabric of the bottom storm flap is stitched to the free end of the upper fabric of the bottom storm flap by concealed stitching.

4. The seamless front panel assembly according to claim 1, wherein the free end of the lower fabric of the first zipper anchoring flap is stitched to the free end of the upper fabric of the first zipper anchoring flap by concealed stitching.

5. The seamless front panel assembly according to claim 4, wherein the upper fabric of the first zipper anchoring flap further includes a thermal tape provided at where the fixing end of the upper fabric of the first zipper anchoring flap is stitched to the fixing end of the lower fabric of the top storm flap.

6. The seamless front panel assembly according to claim 1, wherein the free end of the lower fabric of the second zipper anchoring flap is stitched to the free end of the upper fabric of the second zipper anchoring flap by concealed stitching.

7. The seamless front panel assembly according to claim 6, wherein the upper fabric of the second zipper anchoring flap further includes a thermal tape at where the fixing end of the upper fabric of the second zipper anchoring flap is stitched to the fixing end of the lower fabric of the bottom storm flap.

8. The seamless front panel assembly according to claim 1, wherein the free ends of the upper fabric and lower fabric of the bottom storm flap are folded over towards the upper fabric of the bottom storm flap and stitched to the upper fabric of the bottom storm flap at opposing ends to form a gutter.

9. The seamless front panel assembly according to claim 1, wherein the lower fabrics of the first and second zipper anchoring flaps each include a free end being stitched to the lining of the jacket.

10. The seamless front panel assembly according to claim 1, wherein the first and second front panels and, the outer and bottom storm flaps, the first and second zipper anchoring flaps, and the first and second zipper tapes are impregnated woven fabric.

11. The seamless front panel assembly according to claim 1, wherein the first and second front panels and, the outer and bottom storm flaps, the first and second zipper anchoring flaps, and the first and second zipper tapes are non-impregnated woven fabric.

12. The seamless front panel assembly according to claim 1, wherein the thermally meltable compound is a thermally meltable polyurethane resin.

13. The seamless front panel assembly according to claim 12, wherein the thermally meltable polyurethane resin is heated by a thermal welding machine to result in adhesion effects.

14. The seamless front panel assembly according to claim 1, wherein the bottom storm flap extends beyond where the tooth sides engage, and the top storm flap extends above the bottom storm flap.

15. The seamless front panel assembly according to claim 14, further comprising: matching fasteners provided to the lower fabric of the top storm flap and the top layer fabric of the bottom storm flap, respectively, to allow proper attachment of the top storm flap to the bottom storm flap upon engagement of the zipper tapes.

16. A seamless front flap assembly for a garment having a first front panel and a second front panel in a side-by-side configuration, the assembly comprising:

a top storm flap including: an upper fabric extending from the first front panel; a lower fabric stitched to the upper fabric of the top storm flap by concealed stitching; and a thermally meltable compound for adhering the upper fabric to the lower fabric of the top storm flap;

a bottom storm flap including: an upper fabric extending from the second front panel; a lower fabric stitched to the upper fabric of the bottom storm flap by concealed stitching; and a thermally meltable compound for adhering the upper fabric to the lower fabric of the bottom storm flap;

a first zipper anchoring flap including: an upper fabric stitched to the lower fabric of the top storm flap; and a lower fabric stitched to the upper fabric of the first zipper anchoring flap by concealed stitching;

a second zipper anchoring flap including: an upper fabric stitched to the lower fabric of the bottom storm flap; and a lower fabric stitched to the upper fabric of the second zipper anchoring flap by concealed stitching; and a zipper including: a first zipper tape and a second zipper tape, each zipper tape being stitched to the first zipper anchoring flap and the second zipper anchoring flap, respectively.

17. The seamless front panel assembly according to claim 16, wherein the upper fabric and lower fabric of the bottom storm flap are folded over towards the upper fabric of the bottom storm flap and stitched to the upper fabric of the bottom storm flap at opposing ends to form a gutter.

18. The seamless front panel assembly according to claim 16, wherein the upper fabric of the first zipper anchoring flap further includes a thermal tape positioned where the upper fabric of the first zipper anchoring flap is stitched to the lower fabric of the top storm flap, and wherein the upper fabric of the second zipper anchoring flap further includes a thermal tape at where the upper fabric of the second zipper anchoring flap is stitched to the lower fabric of the bottom storm flap.

19. The seamless front panel assembly according to claim 16, wherein the bottom storm flap extends beyond where the tooth sides engage, and the top storm flap extends above the bottom storm flap.

20. The seamless front panel assembly according to claim 19, further comprising: matching fasteners provided to the lower fabric of the top storm flap and the top layer fabric of the bottom storm flap, respectively, to allow proper attachment of the top storm flap to the bottom storm flap upon engagement of the zipper tapes.

* * * * *